US007850369B2

(12) United States Patent
Young et al.

(10) Patent No.: US 7,850,369 B2
(45) Date of Patent: Dec. 14, 2010

(54) DROP-IN BALL BEARING SLIDE ASSEMBLY

(75) Inventors: John Young, Irvine, CA (US); Ron Judge, Corona, CA (US)

(73) Assignee: Jonathan Engineered Solutions, Irvine, CA (US)

( * ) Notice: Subject to any disclaimer, the term of this patent is extended or adjusted under 35 U.S.C. 154(b) by 1104 days.

(21) Appl. No.: 11/470,211

(22) Filed: Sep. 5, 2006

(65) Prior Publication Data

US 2007/0127856 A1 Jun. 7, 2007

Related U.S. Application Data

(60) Provisional application No. 60/714,249, filed on Sep. 2, 2005.

(51) Int. Cl.
*A47B 88/04* (2006.01)

(52) U.S. Cl. ..... 384/18; 312/334.11; 312/348.1

(58) Field of Classification Search ..... 384/18; 312/334.11, 334.17, 348.1, 348.2
See application file for complete search history.

(56) References Cited

U.S. PATENT DOCUMENTS 3,350,854 A * 11/1967 Revell ..... 55/354
4,148,106 A * 4/1979 Gallien ..... 5/296
4,494,806 A 1/1985 Williams et al.
4,872,239 A 10/1989 Ferguson et al.
4,998,828 A 3/1991 Hobbs (Continued)

OTHER PUBLICATIONS

Photos of QualSlide® slide assembly by Central Industrial Supply, stamped Jun. 7, 2006, 13 pages.
Final Office Action mailed on Apr. 14, 2010 in U.S. Appl. No. 11/426,696.
Non-final Office Action mailed Sep. 16, 2009 in U.S. Appl. No. 11/426,696.

*Primary Examiner*—William C Joyce
(74) *Attorney, Agent, or Firm*—Knobbe Martens Olson & Bear, LLP

(57) ABSTRACT

A non-disconnect drop-in ball bearing slide assembly adapted to support an object, such as a computer server, includes a stationary slide and an intermediate slide slidably connected to the stationary slide with at least one ball bearing interposed between the intermediate slide and the stationary slide. A ball bearing retainer has a top member and a base member, the top and base members extending along a length, with a first plurality of ball bearings extending along the length of the base member, and a second plurality of ball bearings extending along at least a portion of the length of the top member. The non-disconnect drop-in ball bearing assembly also includes a moveable slide extending along a length and having a top rail and a bottom rail. The moveable slide has at least one slot formed on the top rail for receiving a mounting post of an object, such as a server or server mounting arm. The moveable slide is slidably supported within the intermediate slide by the ball bearing retainer, wherein the first plurality of ball bearings are interposed between the bottom rail and the base member and the second plurality of ball bearings are interposed between the top rail and the top member. Access to the at least one slot is unobstructed by the second plurality of ball bearings when the moveable slide is in an extended position outside the stationary slide, thus facilitating the mounting of an object, such as the computer server, to the drop-in ball bearing slide assembly.

22 Claims, 12 Drawing Sheets

U.S. PATENT DOCUMENTS

| | | | | |
|---|---|---|---|---|
| 5,085,523 | A | 2/1992 | Hobbs | |
| 5,302,016 | A | 4/1994 | Lautenschlager et al. | |
| 5,474,375 | A | 12/1995 | Hollenstein et al. | |
| 6,254,210 | B1 | 7/2001 | Parvin | |
| 6,340,078 | B1 | 1/2002 | Scheible | |
| 6,379,045 | B1 * | 4/2002 | Cirocco | 384/18 |
| 6,390,575 | B1 | 5/2002 | Chen et al. | |
| 6,450,600 | B1 | 9/2002 | Chen et al. | |
| 6,464,311 | B2 | 10/2002 | Liang et al. | |
| 6,473,936 | B2 | 11/2002 | Orita | |
| 6,554,379 | B2 | 4/2003 | Devine | |
| 6,601,933 | B1 | 8/2003 | Greenwald | |
| 6,629,738 | B2 | 10/2003 | Salice | |
| 6,652,050 | B2 | 11/2003 | Lin | |
| 6,666,306 | B2 | 12/2003 | Gasser | |
| 6,672,692 | B2 | 1/2004 | Weng | |
| 6,733,097 | B2 | 5/2004 | Kim et al. | |
| 6,796,625 | B2 | 9/2004 | Lauchner et al. | |
| 6,799,817 | B1 | 10/2004 | Chu | |
| 6,817,685 | B2 | 11/2004 | Lammens | |
| 6,846,053 | B2 | 1/2005 | Salice | |
| 6,848,759 | B2 | 2/2005 | Doornbos et al. | |
| 6,883,885 | B2 | 4/2005 | Judge et al. | |
| 6,926,377 | B2 | 8/2005 | Lammens et al. | |
| 6,938,967 | B2 * | 9/2005 | Dubon et al. | 312/333 |
| 7,040,725 | B1 | 5/2006 | Mao-Chin | |
| 7,077,487 | B2 | 7/2006 | Yang | |
| 7,077,488 | B2 | 7/2006 | Wiklund et al. | |
| 7,083,243 | B2 | 8/2006 | Lee | |
| 7,108,339 | B2 | 9/2006 | Berger | |
| 7,159,958 | B1 | 1/2007 | Lu | |
| 7,281,773 | B2 | 10/2007 | Sato et al. | |
| 2001/0008037 | A1 | 7/2001 | Brustle | |
| 2002/0011766 | A1 | 1/2002 | Kim et al. | |
| 2002/0021061 | A1 | 2/2002 | Lammens | |
| 2002/0057042 | A1 | 5/2002 | Milligan | |
| 2003/0080659 | A1 | 5/2003 | Judge et al. | |
| 2003/0111942 | A1 | 6/2003 | Judge et al. | |
| 2004/0080245 | A1 | 4/2004 | Lammens et al. | |
| 2004/0183411 | A1 | 9/2004 | Boks | |
| 2004/0227438 | A1 | 11/2004 | Tseng et al. | |
| 2004/0239218 | A1 | 12/2004 | Jurja | |
| 2004/0239221 | A1 | 12/2004 | Yang | |
| 2005/0104492 | A1 | 5/2005 | Chiu | |
| 2006/0120636 | A1 | 6/2006 | Chen et al. | |
| 2007/0001562 | A1 | 1/2007 | Park | |

* cited by examiner

DROP-IN BALL BEARING SLIDE ASSEMBLY

CROSS-REFERENCE TO RELATED APPLICATIONS

This application claims the benefit of U.S. Provisional Patent Application No. 60/714,249, filed Sep. 2, 2005, the entire contents of which are hereby incorporated by reference and should be considered a part of this specification.

BACKGROUND OF THE INVENTION

1. Field of the Invention

The present invention relates to slide assemblies, and more particularly to drop-in ball bearing slide assemblies.

2. Description of the Related Art

For convenience and to conserve floor space, computer servers for high capacity computer systems are often mounted in rack structures. Typically, several computer servers are mounted in each rack structure. Each server is typically mounted on a pair of slide assemblies to allow the server to slide in and out of the rack structure for convenient access to the server. Each slide assembly comprises two or more slide segments. In slide assemblies comprising only two slide segments, a first or outer slide segment is mounted to a frame of the rack structure, and a second or inner slide segment is mounted to the server. The outer slide segment defines a channel. The inner slide segment is movable in the channel to extend or retract the slide assembly. A bearing assembly is movably positioned in the channel to facilitate sliding movement of the inner slide segment with respect to the outer slide segment.

In quick disconnect slide assemblies, the inner slide segments, which are attached to a computer server, can be entirely removed from the channel and thus detached from the outer slide segments. This allows convenient removal of the computer server from the server rack structure for repair or replacement of the computer server. The inner slide segment remains attached to the computer server when the server is removed from the rack. To replace the computer server in the server rack, the server must be mounted to the inner slide segment. However, in order to put the computer server back into the enclosure or server rack, the inner-slide members (with the computer server attached to them) have to be reinserted to the rest of the slide assembly by guiding the inner slide segment into the outer slide segment. One disadvantage of such slide assemblies is that aligning the inner-slide segments with the outer-slide segments may be difficult, and misalignment of said segments may result in the fall of the computers server, resulting in damage to it or injury to a user.

Conventional drop-in slide assemblies are friction slides. In such slides, mounts attached to the object (e.g., a computer server) drop into slots formed on the inner slide segment, so that a computer server having such mounts can be decoupled from and re-coupled with the slide assembly. However, for heavy load applications, such friction slides are cumbersome and difficult to use due to the increased friction force generated between the slide segments of the slide assembly.

Accordingly, there is a need for an improved slide assembly that avoids some of the problems discussed above.

SUMMARY OF THE INVENTION

Accordingly, it is the principle object of the present invention to provide an improved drop-in ball bearing slide assembly.

In accordance with one aspect of the present invention, a non-disconnect drop-in ball bearing slide assembly for supporting an object is provided. The slide assembly comprises a stationary slide, an intermediate slide, a ball bearing retainer, and a movable slide. The intermediate slide is slidably supported within the stationary slide, and has a top rail, a bottom rail, and at least one aperture formed on the top rail at a distal end of the intermediate slide. The ball bearing retainer has a first elongate member, a second elongate member and at least one connecting member between the elongate members, wherein the first and second elongate members extend along a length. A first plurality of ball bearings extend along the length of the first member, and a second plurality of ball bearings extend along at least a portion of the length of the second member wherein the first and second plurality of ball bearings are captivated in the first and second elongate members, respectively. The movable slide extends along a length and has a first member and a second member. The movable slide has a first slot and a second slot formed on the first member, wherein each slot is configured to receive a corresponding mount of an object. The movable slide is slidably supported within the intermediate slide by at least a portion of the ball bearing retainer, wherein the first plurality of ball bearings are interposed between the first member and the top rail and the second plurality of ball bearings are interposed between the second member and bottom rail, wherein the first slot is disposed within the intermediate slide when the movable slide is in the extended position, and the first slot is aligned with one of the at least one aperture on the intermediate slide.

In accordance with another aspect of the present invention, a drop-in ball bearing assembly for supporting an object is provided comprising a stationary slide, an intermediate slide, a ball bearing retainer, and a movable slide. The intermediate slide is slidably connected to the stationary slide with at least one ball bearing interposed between the intermediate slide and the stationary slide. The ball bearing retainer has a top member and a base member, wherein the top and base members extend along a length. A first plurality of ball bearings extend along the length of the base member and a second plurality of ball bearings extend along at least a portion of the length of the top member. The movable slide extends along a length and has a top rail and a bottom rail. The movable slide also has at least one slot formed on the top rail for receiving a mount of an object. The movable slide is supported within an intermediate slide by at least a portion of the ball bearing retainer, wherein the first plurality of ball bearings are interposed between the bottom rail and the base member, and the second plurality of ball bearings are interposed between the top rail and the top member. Access to the at least one slide is unobstructed by the second plurality of ball bearings when the movable slide is in an extended position outside the stationary slide.

In accordance with yet another aspect of the present invention, a drop-in ball bearing slide assembly for supporting an object is provided comprising a stationary slide, an intermediate slide, a ball bearing retainer, and a movable slide. The intermediate slide is slidably mounted to the stationary slide. The ball bearing retainer has a first elongate member and a second elongate member with at least one connecting member between the elongate members. The first and second elongate members extend along a length, and a first plurality of ball bearings extend along the length of the first member with a second plurality of ball bearings extending along at least a portion of the length of the second member. The movable slide extends along a length and has a top member and a bottom member. The movable slide also has at least one slot for receiving a mount of an object, and is slidably mounted to the intermediate slide via the ball bearing retainer. The first plurality of ball bearings are interposed between the first member and the bottom member and a second plurality of ball bearings are interposed between the second member and the top member, wherein access to the at least one slot is unobstructed when the movable slide is an extended position outside the stationary slide.

Certain objects and advantages of the invention are described herein. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of the embodiments summarized above are intended to be within the scope of the invention herein disclosed. However, despite the foregoing discussion of certain embodiments, only the appended claims (and not the present summary) are intended to define the invention. The summarized embodiments, and other embodiments of the present invention, will become readily apparent to those skilled in the art from the following detailed description of the preferred embodiments having reference to the attached figures, the invention not being limited to any particular embodiment(s) disclosed.

DETAILED DESCRIPTION OF THE PREFERRED EMBODIMENT

In the following detailed description, terms of orientation such as "top," "bottom," "upper," "lower," "front," "rear," and "end" are used herein to simplify the description of the context of the illustrated embodiments. Likewise, terms of sequence, such as "first" and "second," are used to simplify the description of the illustrated embodiments. Because other orientations and sequences are possible, however, the present invention should not be limited to the illustrated orientation. Those skilled in the art will appreciate that other orientations of the various components described above are possible.

Figure 1:
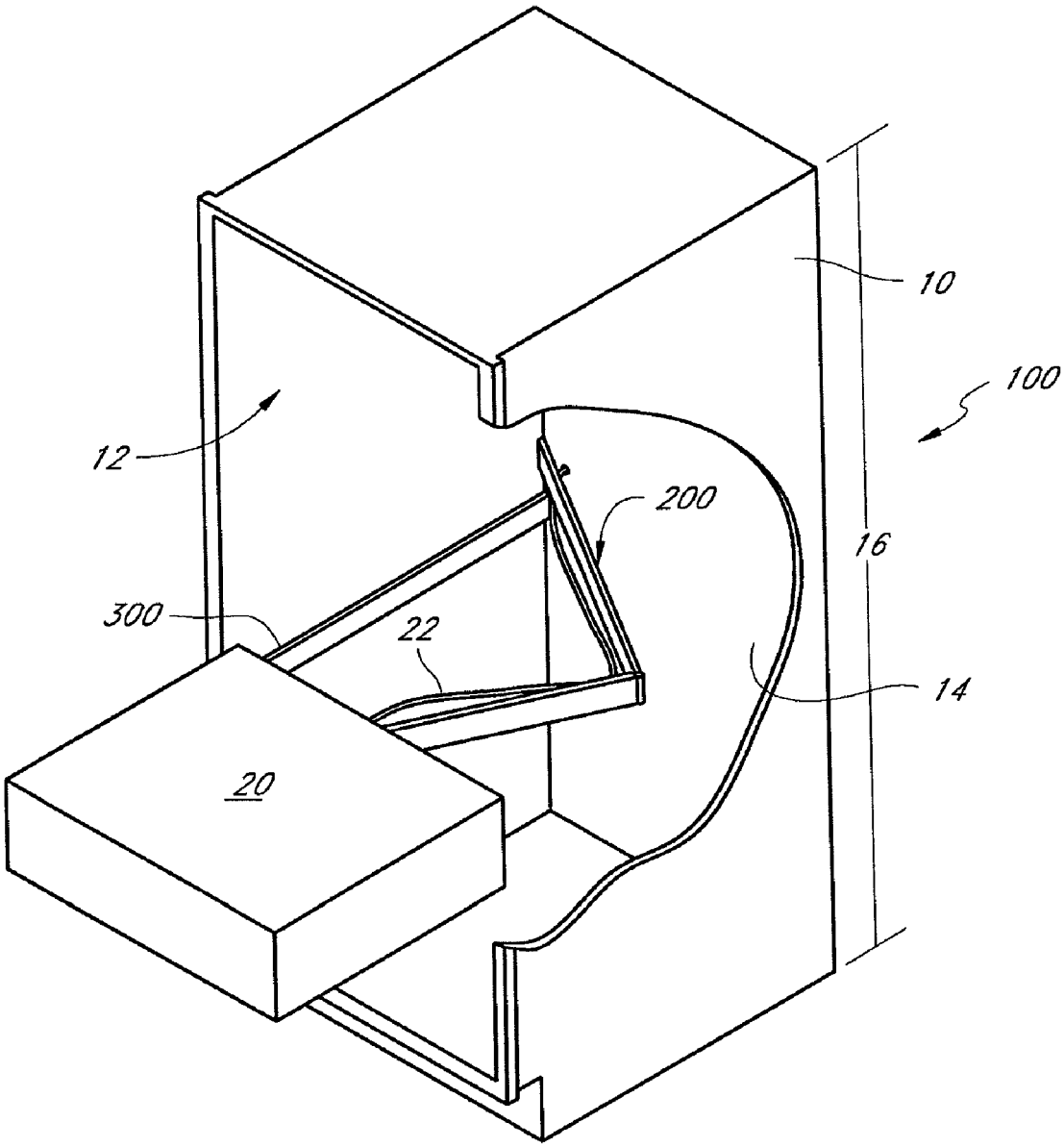
FIG. 1 is a perspective view of a server management system in accordance with one of the embodiments disclosed herein.

FIG. 1 illustrates one embodiment of the server management system 100. The server management system 100 preferably comprises a rack frame 10 having a front portion 12, a rear portion 14, and extending along a height 16. The server management system also comprises at least one server 20 movably mounted on the rack frame 10. In one embodiment, the server management system 100 comprises a plurality of servers 20 stacked on top of one another along the height 16 of the rack frame 10. Preferably, each of the servers 20 is movable in and out of the server rack 10 along at least one slide assembly 300. Though only one slide assembly 300 is shown in FIG. 1, each server 20 is preferably removably attached to two slide assemblies 300, one on either side of the server 20. Additionally, each of the servers 20 preferably has at least one cable 22 extending from a rear portion of the server 20 toward the rear portion 14 of the rack frame 10. In a preferred embodiment, a cable management tool 200 disposed between the rear portion of the rack frame 10 and the rear portion 14 of the server 20 preferably maintains the at least one cable in an ordered configuration. Further details of a suitable cable management tool are disclosed in U.S. application Ser. No. 11/386,030, filed Mar. 20, 2006, the entire contents of which are hereby incorporated by reference and should be considered a part of this specification.

Figure 2:
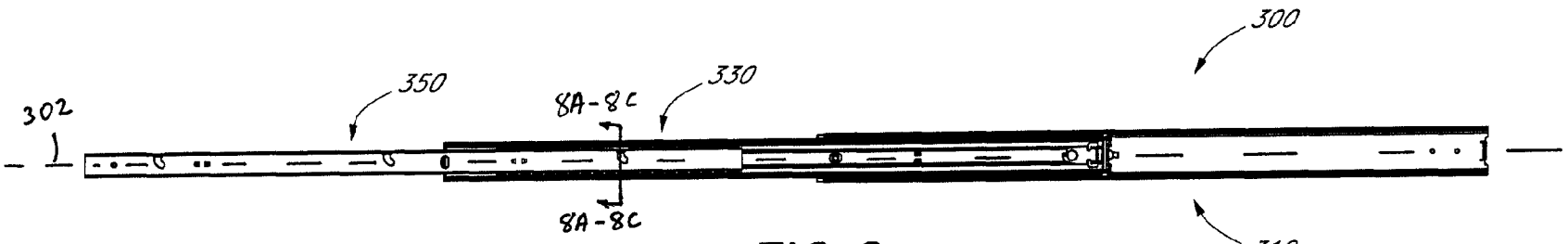
FIG. 2 is a schematic side view of a drop-in ball bearing slide assembly in accordance with one of the embodiments disclosed herein.

One embodiment of a slide assembly 300 is illustrated in FIG. 2. In the illustrated embodiment, the slide assembly 300 is a non-disconnect slide assembly and includes a first or stationary slide segment 310, a second or intermediate slide segment 330, and a third or movable slide segment 350. However, in other embodiments, the slide assembly can include more or fewer slide segments. The stationary slide segment 310 is adapted for mounting to an inner surface of the rack frame 10, as shown in FIG. 1. Likewise, the movable slide segment 350 is adapted for mounting to the server 20 as described further below. Each computer server 20 desirably is supported in the server rack structure 10 by a pair of side assemblies 300, one on either side of the computer server 20, to allow the computer server to slide in and out of the server rack structure 10.

Figure 3:
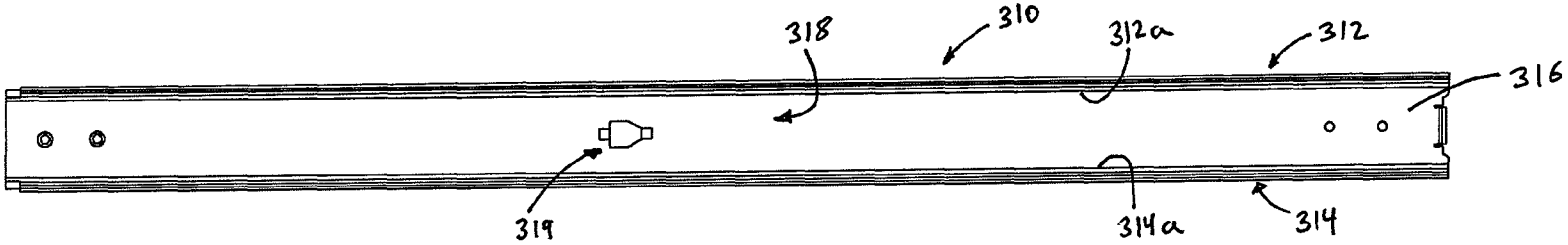
FIG. 3 is a schematic side view of a stationary slide in accordance with one of the embodiments disclosed herein.

FIG. 3 illustrates a side view of the stationary slide segment 310. Preferably, the stationary slide segment 310 has a generally C-shaped cross-section and comprises an upper wall 312, a lower wall 314, and a side wall 316 extending between the upper 312 and lower walls 314. The upper and lower walls 312, 314 and the side wall 316 define a channel 318 therebetween. In one preferred embodiment, each of the upper and lower walls 312, 314 defines a bearing surface 312*a*, 314*a*. In one embodiment, the bearing surfaces 312*a*, 314*a* of the upper and lower walls 312, 314 is arcuate. Preferably, the bearing surfaces 312*a*, 314*a* of the stationary slide segment 310 face inward, or toward a central longitudinal axis 302 of the slide assembly 300. The stationary slide segment 310 also preferably includes a protrusion 319 that extends from the side wall 316 into the channel 318.

Figure 4:
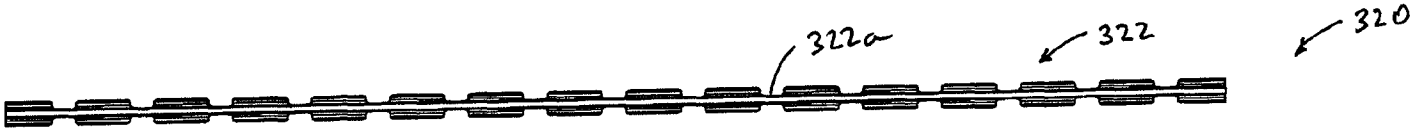
FIG. 4 is a schematic side view of a ball bearing race unit in accordance with one of the embodiments disclosed herein.
Figure 4:
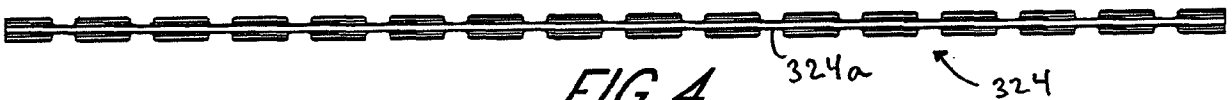

FIG. 4 illustrates the side view of a ball bearing spacer 320 in accordance with one embodiment. In the illustrated embodiment, the ball bearing spacer 320 comprises an upper set of ball bearings 322 and a lower set of ball bearings 324, wherein the upper set of ball bearings 322 is configured to be positioned between the inner bearing surface 312*a* of the upper wall 312 of the stationary slide 310 and the outer bearing surface 332*b* of the upper wall 332 of the intermediate slide 330. Likewise, the lower set of ball bearings 324 is configured to be positioned between the inner bearing surface 312*b* of the lower wall 314 of the stationary slide 310 and the outer bearing surface 334*b* of the lower wall 334 of the intermediate slide 330. The ball bearing spacer 320 preferably comprises thin, elongated, generally planar bearing spacers 322*a*, 324*a* coupled to the upper and lower sets of ball bearings 322, 324, respectively.

Figure 5:
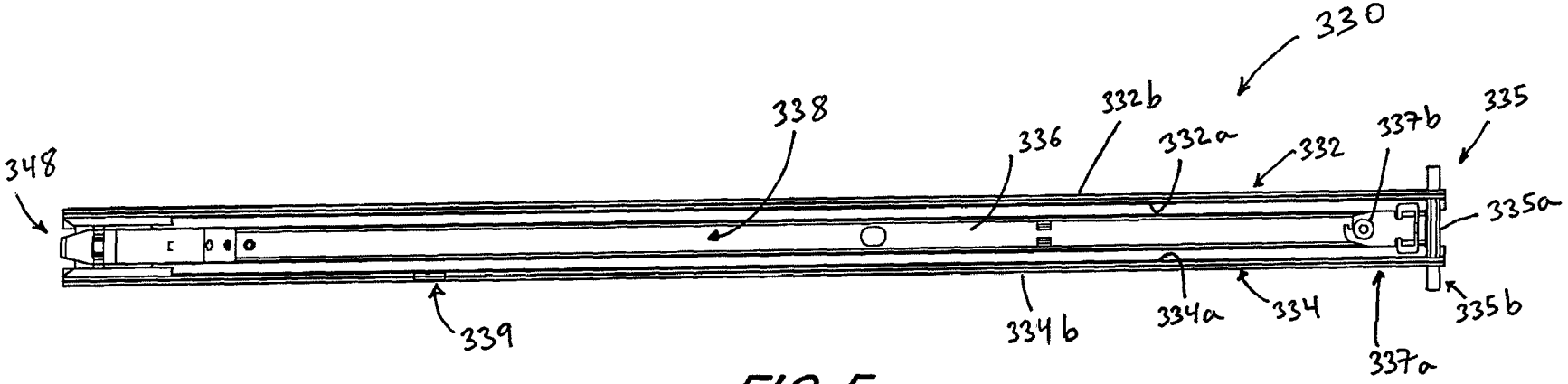
FIG. 5 is a schematic side view of an intermediate slide in accordance with one of the embodiments disclosed herein.

The intermediate slide segment 330 also preferably has a generally C-shaped cross-section and comprises an upper wall 332, a lower wall 334, and a side wall 336 extending between the upper and lower walls 332, 334, as shown in FIG. 5. Preferably, each of the upper and lower walls 332, 334 of the intermediate slide segment 330 defines an arcuate inner bearing surface 332*a*, 334*a* and an arcuate outer bearing surface 332*b*, 334*b*. The inner bearing surfaces 332*a*, 334*a* face towards, and the outer bearing surfaces 332*b*, 334*b* face away from, the central longitudinal axis 302 of the slide assembly 300. A longitudinal channel 338 is defined by the inner bearing surfaces 332*b*, 334*b* and an inner surface 336*a* of the side wall 336.

Additionally, as shown in FIGS. 2 and 5, the intermediate slide segment 330 includes a stop member 335 proximate one end of the intermediate slide segment 330. In the illustrated embodiment, the stop member 335 includes a boss 335*a* disposed in the channel 338 and extending between the upper and lower walls 332, 334. In the illustrated embodiment, the stop member 335 also includes a pin 335*b* extending or protruding out from the boss 335*a* and through the upper and lower walls 332, 334. In one embodiment, the boss 335*a* and pin 335*b* are separate components. However, in another embodiment, the boss 335*a* and the pin 335*b* can be a single piece. The boss 335 advantageously limits the travel of the movable slide member 350 and a ball bearing retainer between the intermediate slide member 330 and the moveable slide member 350, which is discussed further below, once the movable slide member 350 has been moved into a fully retracted position relative to the intermediate slide segment 330. Similarly, the pin 335*b* limits the travel of the ball bearing spacer 320 disposed between the intermediate slide segment 330 and the stationary slide segment 310.

The intermediate slide segment 330 also includes a lock arm 337*a*, which preferably pivots about a pin 337*b*. The lock arm 337*a* has a channel-shaped portion 337*c*, through which the protrusion 319 on the stationary slide 310 travels when the intermediate slide 330 is moved into a fully extended position out of the stationary slide 310. Once in the fully-extended position, the lock arm 337*a* preferably clears the protrusion 319 and pivots about the pin 337*b* to lock the intermediate slide 330 in the fully extended position relative to the stationary slide 310. In one embodiment, the arm 337*a* pivots so as to abut against the protrusion 319 if an attempt is made to retract the intermediate slide 330 form the fully extended position into the stationary slide 310. In one embodiment, an unlocking mechanism (not shown) preferably aligns the lock arm 337*a* with the protrusion 319, allowing the intermediate slide 330 to retract into the stationary slide 310. In another embodiment, when the intermediate slide segment 330 is moved into a fully extended position, the protrusion 319 travels into and frictionally engages the lock arm 337*a*, thus substantially locking the position of the intermediate slide 330 in the extended position relative to the stationary slide segment 310 and inhibiting the inadvertent movement of the intermediate slide 330 from said fully extended position. However, the friction force between the lock arm 337*a* and the protrusion 319 is preferably overcome by a user exerting a desired amount of force on the intermediate slide 330 to retract it into the stationary slide 310.

Figure 7:
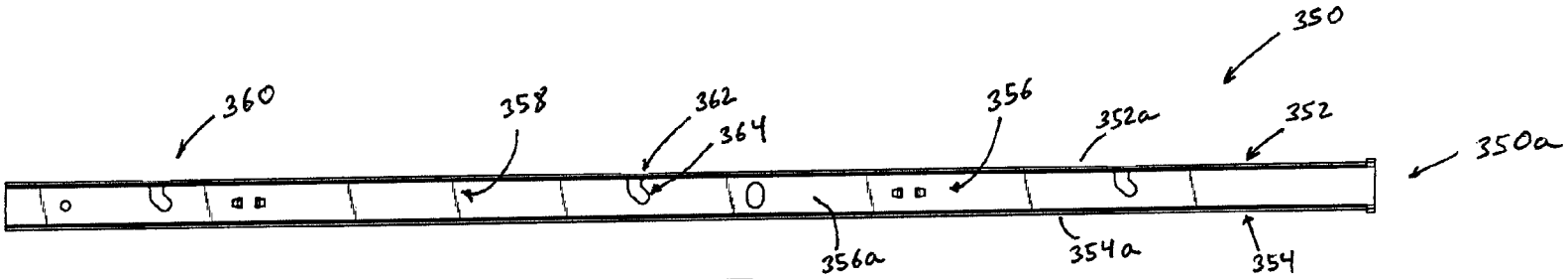
FIG. 7 is a schematic side view of a movable slide in accordance with one of the embodiments disclosed herein.

FIG. 7 shows a side view of the movable slide 350 of the slide assembly 300. With reference to FIGS. 7, and 8A-8C, the movable slide segment 350 preferably also has a generally C-shaped cross-section and comprises an upper wall 352, a lower wall 354, and a planar side wall 356 extending between the upper and lower walls 352, 354. Each of the upper and lower walls 352, 354 preferably defines an arcuate bearing surface 352*a*, 354*a*. The bearing surfaces 352*a*, 354*a* generally face outward away from the central longitudinal axis 302 of the slide assembly 300. Preferably, a longitudinal channel 358 is defined by the bearing surfaces 352*a*, 354*a* and a planar inner surface 356*a* of the side wall 356. Additionally, as seen in FIG. 7, the movable slide 350 comprises multiple slots 360 formed on the upper wall 352 thereof. In the illustrated embodiment, the movable slide 350 has three slots 360 formed on the upper wall 352 at generally equidistant intervals. However, the slots 360 can be spaced apart at equidistant or non-equidistant intervals. Additionally, more or fewer slots can be formed on the movable slide. Preferably, each slot 360 comprises a saddle portion or opening 362 and a neck portion 364, as illustrated in FIG. 7. In a preferred embodiment, the opening 362 of the slot 360 is wider than the neck portion 364 of the slot 360. In a preferred embodiment, the slot 360 is J-shaped. However, the slots can have other suitable shapes, such as L-shaped.

Figure 6A:
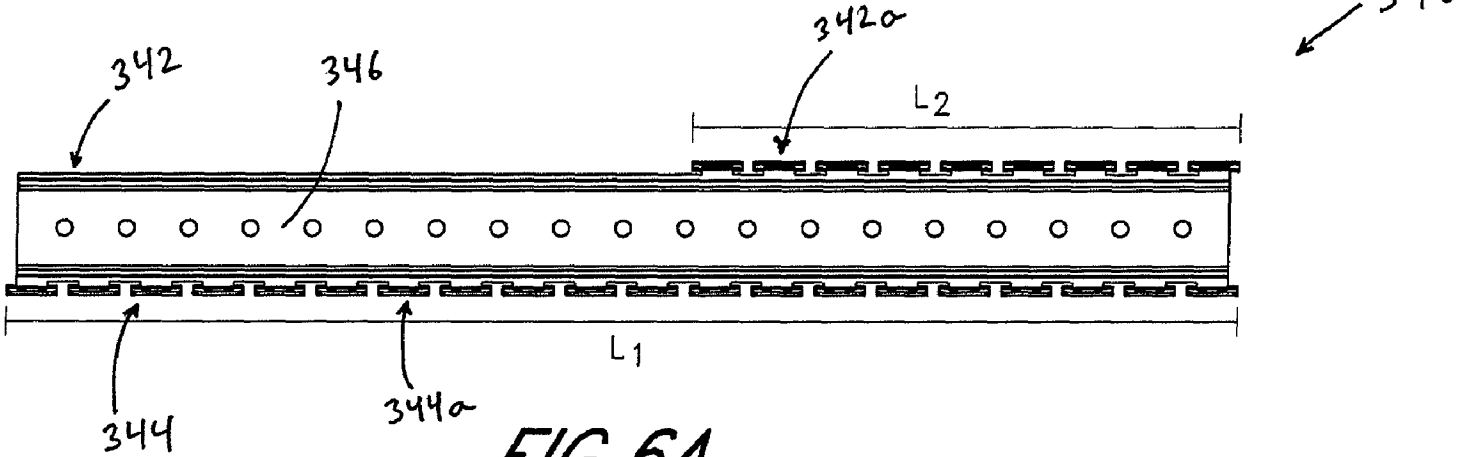
FIG. 6A is a schematic side view of one embodiment of a ball bearing support in accordance with one embodiment.

FIG. 6A illustrates a side view of one embodiment of ball bearing retainer 340. In a preferred embodiment, the ball bearing retainer 340 comprises a top or first elongate member 342, a bottom or second elongate member 344 and a connecting member 346 between the first and second elongate members 342, 344. As shown in FIG. 6A, the connecting member 346 consists of a wall 346 extending between the first elongate member 342 and the second elongate member 344. Preferably, a first set of ball bearings 342*a* is captivated by the first elongate member 342 and a second set of ball bearings 344*a* is captivated by the second elongate member 344. As illustrated in FIG. 6A, the second set of ball bearings 344*a* extends along a length L1 substantially equal to the length of the second elongate member 344, whereas the first set of ball bearings 342*a* extend along a length L2 less than the length L1 of the first elongate member 342. As illustrated in FIGS. 2 and 8A-8C, the first set of ball bearings 342*a* preferably ride between the inner bearing surface 332*a* of the intermediate slide 330 and the bearing surface 352*a* of the movable slide 350. Likewise, the second set of ball bearings 344*a* preferably slide between the inner bearing surface 334*a* of the intermediate slide 330 and the bearing surface 354*a* of the movable slide 350. In one embodiment, a lead-in guide 348 (see FIG. 5) can be disposed along the inner bearing surface 334*a* of the intermediate slide 330. Preferably, the lead-in guide 348 has a length L2-L1 and substantially inhibits the movable slide 350 from twisting out of engagement with the intermediate slide 330.

Preferably, the ball bearing retainer 340 rotatingly supports the first and second plurality of ball bearings 342*a*, 344*a*. In one embodiment, the ball bearing support 340 is a bridge ball retainer. In this embodiment, at least a portion of the first elongate member 342 extends between each of the first plurality of ball bearings 342*a*. Likewise, at least a portion of the second elongate member 344 extends between each of the second plurality of the ball bearings 344*a*. Accordingly, the ball bearing retainer 340 preferably retains each of the first plurality of ball bearings 342*a* generally uniformly spaced apart relative to each other and substantially prevents the ball bearings from falling out of the retainer 340. Likewise, the ball bearing retainer 340 preferably retains each of the second plurality of ball bearings 344*a* generally uniformly spaced apart relative to each other and substantially prevents the ball bearings from falling out of the retainer 340. In contrast, a ball bearing spacer, as known in the art, would maintain ball bearings in a spaced apart configuration but would not prevent the ball bearings from falling out of the spacer. One of ordinary skill in the art will recognize that the ball bearing retainer 340 can retain the ball bearings so that they are spaced apart in any desired configuration.

Figure 6B:
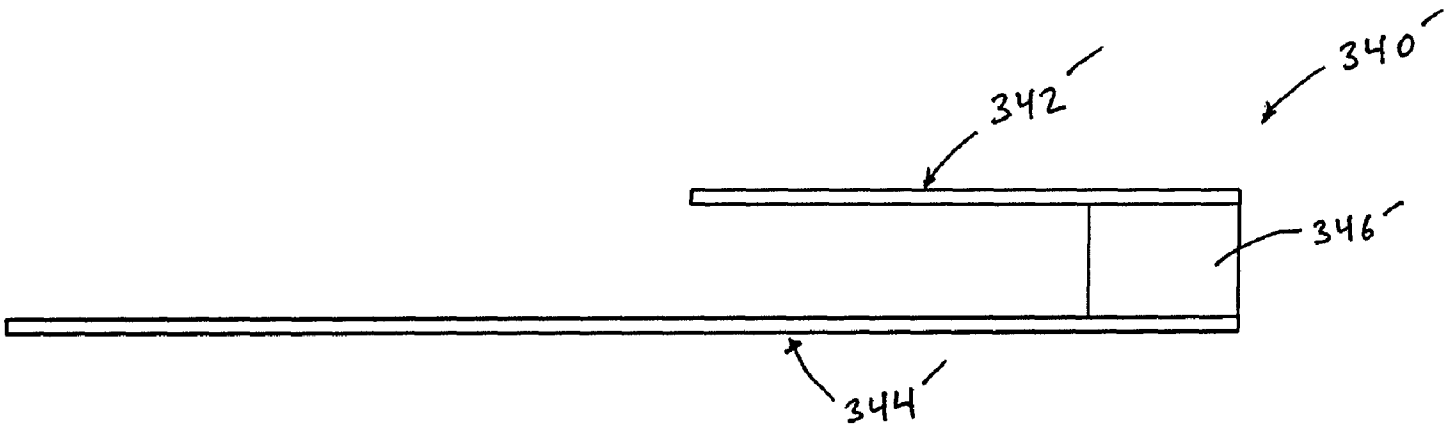
FIG. 6B is a schematic side view of another embodiment of a ball bearing support.

FIG. 6B illustrates another embodiment of a ball bearing retainer 340'. The ball bearing retainer 340' comprises a first elongate member 342' and a second elongate member 344', on which a first and second set of ball bearings (not shown) are captivated, respectively. In the illustrated embodiments, a connector 346' extends between the first and second elongate members 342', 344'. In the illustrated embodiment, one connector 346' is shown. However, multiple connectors 346' can be disposed between the elongate members at equidistant or non-equidistant intervals.

Figure 6C:
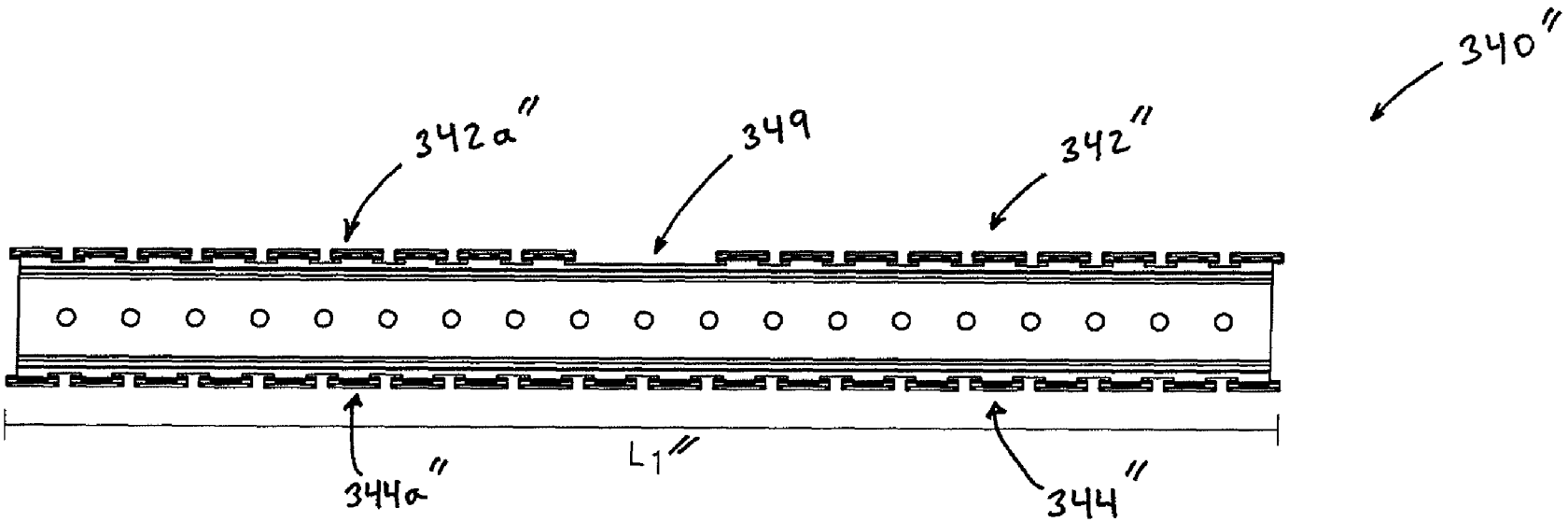
FIG. 6C is a schematic side view of another embodiment of a ball bearing support.

FIG. 6C illustrates another embodiment of a ball bearing retainer 340". The ball bearing retainer 340" is similar to the ball bearing retainer 340 shown in FIG. 6A, except that the first set of ball bearings 342*a*" that are captivated by the first elongate member 342" extend along the same length L1" as the second set of ball bearings 344*a*" that are captivated by the second elongate member 344". Additionally, the ball bearing retainer 340" has an opening 349, which is preferably on at least one of the first elongate member 342" and the connecting member 346", that facilitates the drop-in mounting of an object, such as a server, on the slide assembly 300, as further described below. Having the first and second elongated members 342", 344" with the same length L1" advantageously inhibits the twisting of the movable slide 350 out of engagement with the intermediate slide 330 when the slide assembly 300 is under load.

Figure 8C:
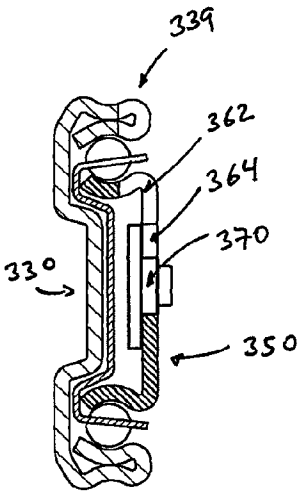
FIG. 8C is a schematic cross-sectional view of the drop-in ball bearing slide assembly in a third position during loading.
Figure 8B:
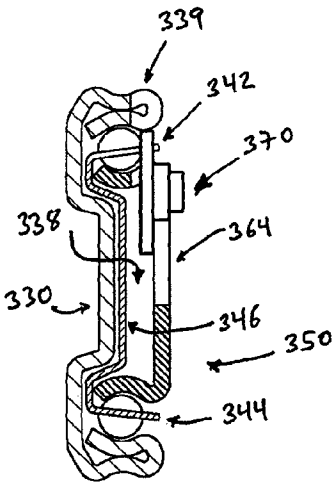
FIG. 8B is a schematic cross-sectional view of the drop-in ball bearing slide assembly in a second position during loading.
Figure 8A:
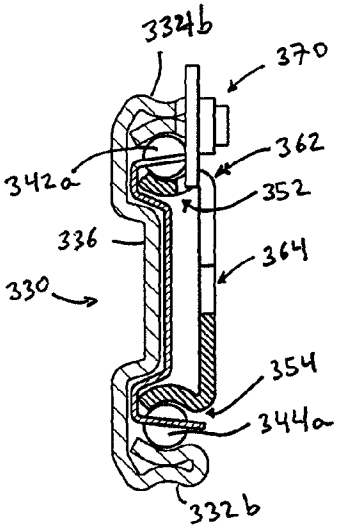
FIG. 8A is a schematic cross-sectional view of the drop-in ball bearing slide assembly in one position during loading.

The intermediate slide segment 330 is positioned in the channel 318 of the stationary slide segment 310, so that the bearing surfaces 312*a*, 314*a* of the stationary slide segment 310 are located adjacent the outer bearing surfaces 332*b*, 334*b* of the intermediate slide segment 330, with the ball bearing spacer 320 disposed between the outer bearing surfaces 332*b*, 334*b* of the intermediate slide 330 and the inner bearing surfaces 312*a*, 314*a* of the stationary slide 310. The ball bearings 322, 324 roll against the bearing surfaces 312*a*, 314*a*, 332*b*, 334*b* to facilitate longitudinal sliding movement of the intermediate slide segment 330 relative to the stationary slide segment 310. As shown in FIGS. 8A-8C, the movable slide segment 350 is positioned in the channel 338 of the intermediate slide segment 330 so that the bearing surfaces 352*a*, 354*a* of the movable slide segment 350 are located adjacent the inner bearing surfaces 332*a*, 334*a* of the intermediate slide segment 330. The ball bearing retainer 340 is positioned in the channel 338 between the movable slide segment 350 and the intermediate slide segment 330 to facilitate longitudinal sliding movement of the movable slides segment 350 with respect to the intermediate slide segment 330.

In a preferred embodiment, the inner bearing surfaces 312*a*, 314*a* of the stationary slide segment 310, the inner and outer bearing surfaces 332*a*, 334*a*, 332*b*, 334*b* of the intermediate slide segment 330, and the bearing surfaces 352*a*, 354*a* of the movable slide segment 350 are all preferably concave. This prevents lateral separation of the intermediate slide segment 330 with respect to the stationary slide segment 310, and of the movable slide segment 350 with respect to the intermediate slide segment 330.

The ball bearing retainer assembly 340 is movable along the length of the channel 338 of the intermediate slide segment 330. This allows the first and second plurality of ball bearings 342*a*, 344*a* to roll along the inner bearing surfaces 332*a*, 334*a* of the intermediate slide segment 330 as the movable slide segment 350 is moved in and out of the channel 338. In a preferred embodiment, a rear stop 359 is provided in a rear portion of the movable slide segment 350 to limit rearward movement of the ball bearing support 340. In the illustrated embodiment, the rear stop 359 consists of a laterally raised portion on the top and bottom members 352, 354 of the movable slide 350, wherein the rear stop 359 is positioned at the proximal end 350*a* of the movable slide 350.

With continuing reference to FIGS. 2 and 8A-8C, the drop-in ball bearing slide assembly 300 advantageously facilitates the installation of a computer server 20 or other object on the movable slide segment 350. As illustrated in FIGS. 8A-8C, the slots 360 in the top member 352 or rail of the movable slide segment 350 are configured to receive a mount 370 attached or fastened to the computer server 20 or object to couple the server 20 to the moveable slide segment 350. Advantageously, at least one of the slots 360 is disposed within the intermediate slide 330 when the movable slide 350 is positioned in a fully extended position. As illustrated in FIG. 2, the slot 360 positioned within the intermediate slide segment 330 aligns with an aperture or opening 339 on the intermediate slide 330 (see FIG. 5), which in turn preferably aligns with the opening 349 in the ball bearing retainer 340". Advantageously, having at least one of said slots 360 positioned within the intermediate slide segment 330, when the movable slide 350 is in the fully extended or loading position, provides additional support to the movable slide 350 during the loading process.

As illustrated in FIGS. 8A-8C, the insertion of the mounts 370 in the slots 360 of the movable slide segment 350 is unobstructed by the first or second plurality of ball bearings 342*a*, 344*a* on the ball bearing retainer 340. Accordingly, the computer server 20 or other object can be readily mounted and dismounted from the movable slide segment 350. Additionally, the retainer 340 advantageously prevents the ball bearings 342*a* from falling out through the slots 360. Moreover, the second plurality of ball bearings 344*a* provide most of the support to the movable slide 350 when the mounts 370 are inserted into the slots 360. Preferably, the neck portion 364 of the slots 360 on the movable slide segment 350 are configured to substantially fix or lock the position of the mounts 370 within the slots 360.

In accordance with the embodiments disclosed above, the drop-in ball bearing slide assembly 300 advantageously provides a slide that is readily movable from a contracted position to an extended position for loading, while simplifying or facilitating the installation of a computer server or other object on the movable slide segment.

Figure 9:
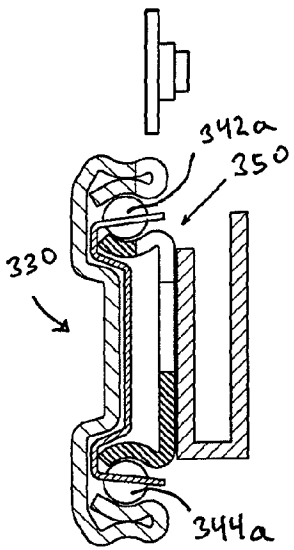
FIG. 9 is a schematic cross-sectional view of another embodiment of a drop-in ball bearing slide assembly.

Another advantage of the drop-in ball-bearing slide assembly 300 is that is has a generally low profile (i.e., thickness) in the transverse cross-section, as shown in FIGS. 8A-8C. In one embodiment, the width W of the slide assembly 300 is between about 1 inch and 3 inches. In another embodiment, the width of the slide assembly 300 is less than about 1 inch, and more preferably about ½ inch. In still another embodiment, the width of the slide assembly is greater than about 3 inches. Accordingly, the slide assembly 300 does not take up a lot of space when installed in the rack frame 10. In another embodiment, a bracket can be attached to the movable slide segment 350, as shown in FIG. 9. However, this embodiment results in an increased width of the slide assembly and requires a user to account for said increased width when preparing the installation of the slide assemblies 300 on the rack frame 10. Additionally, such slide assemblies require the extra cost of the bracket and add weight to the slide assembly.

Figure 10:
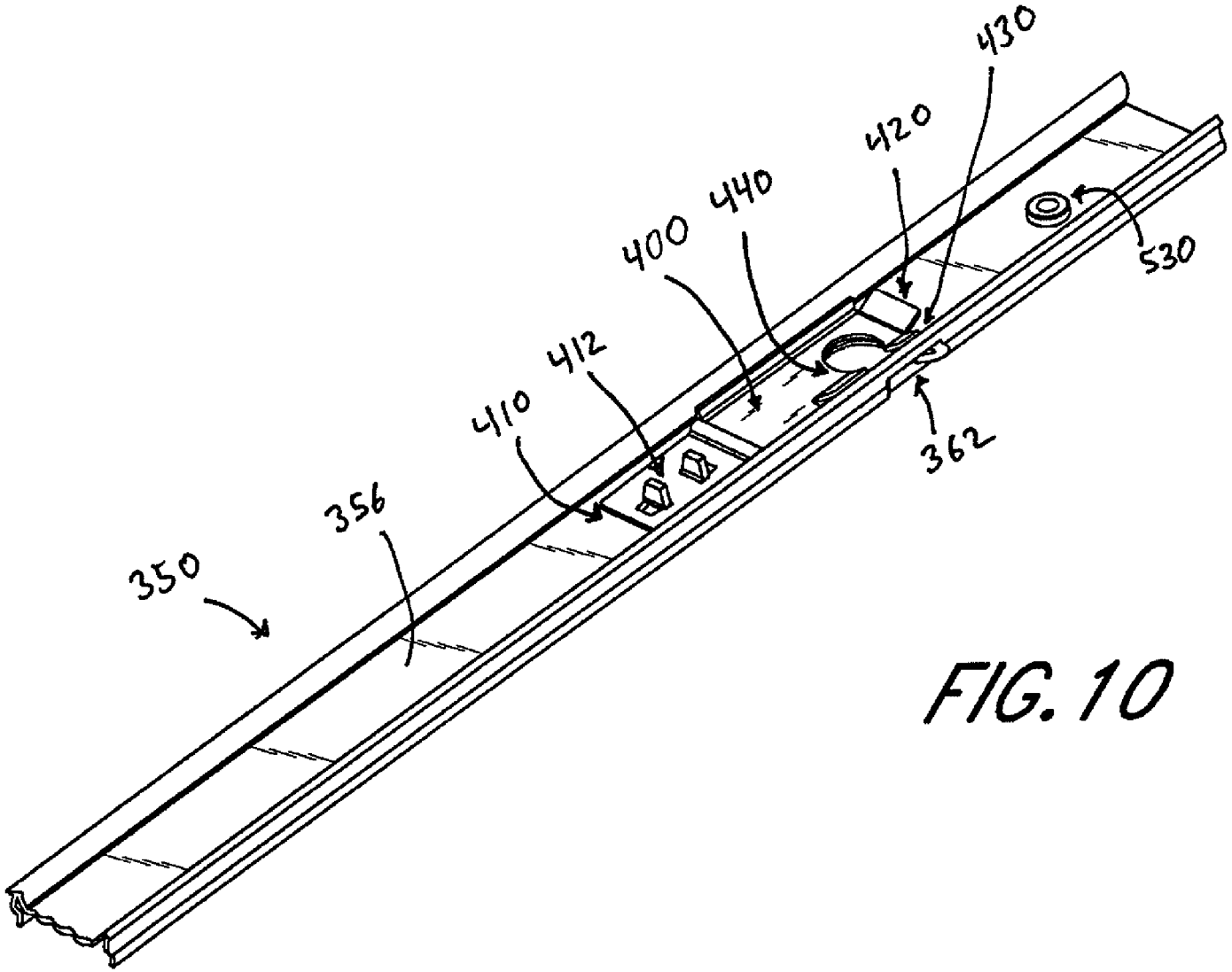
FIG. 10 is a schematic view of a locking member for use with the drop-in ball bearing assembly.
Figure 11A:
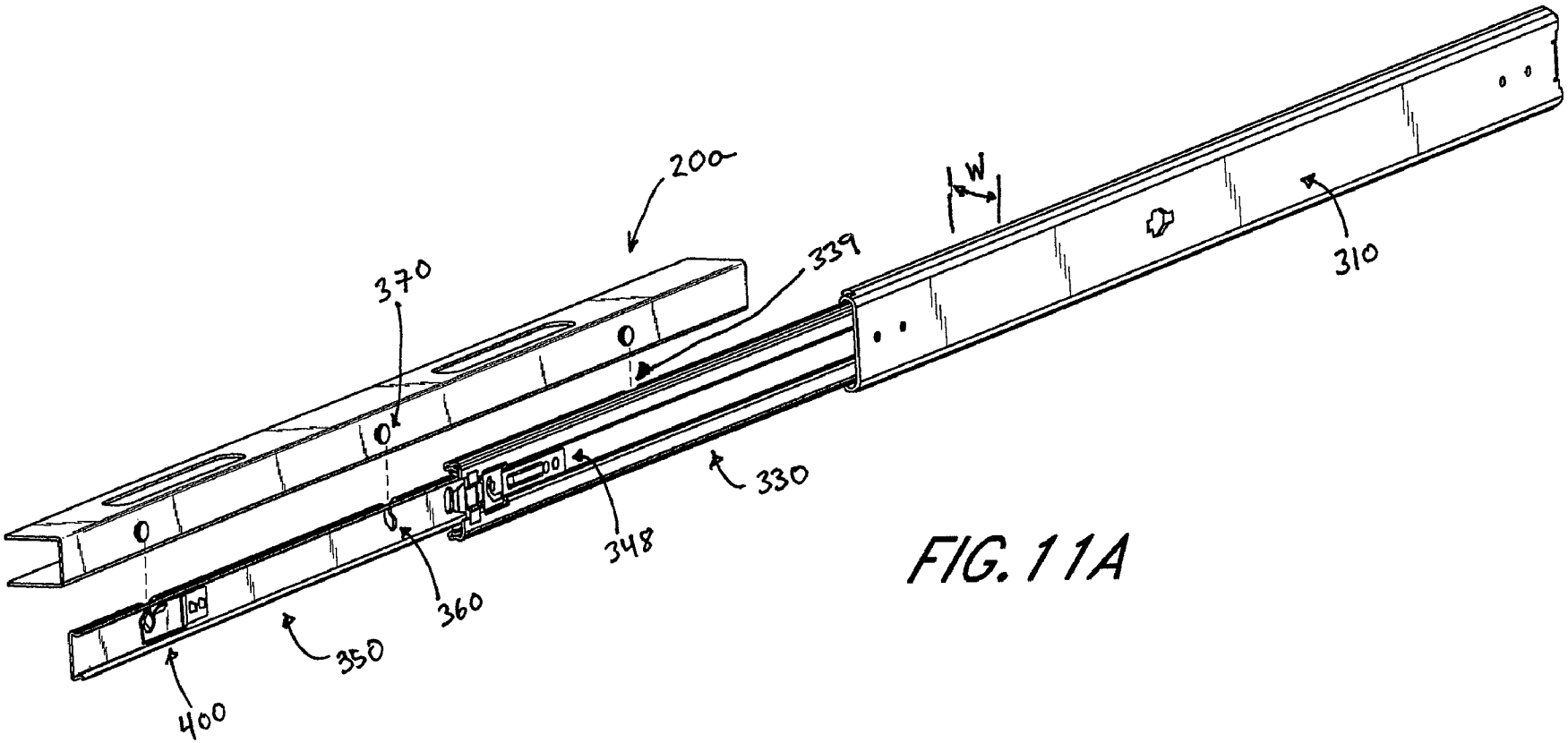
FIG. 11A is a schematic perspective view of a step of a method for attaching an object to the drop-in ball bearing assembly.
Figure 11B:
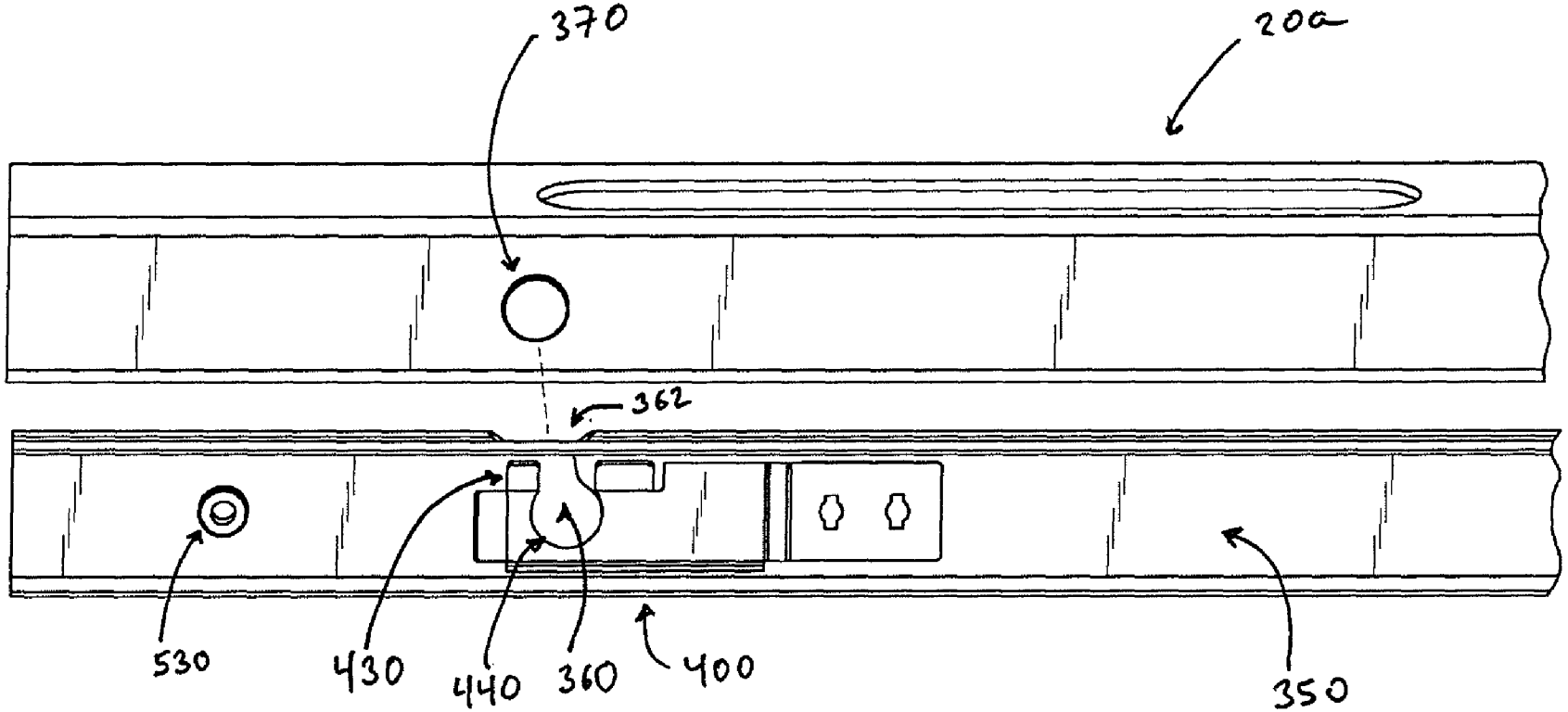
FIG. 11B is a schematic side view of another step of the method for attaching an object to the drop-in ball bearing assembly.
Figure 11C:
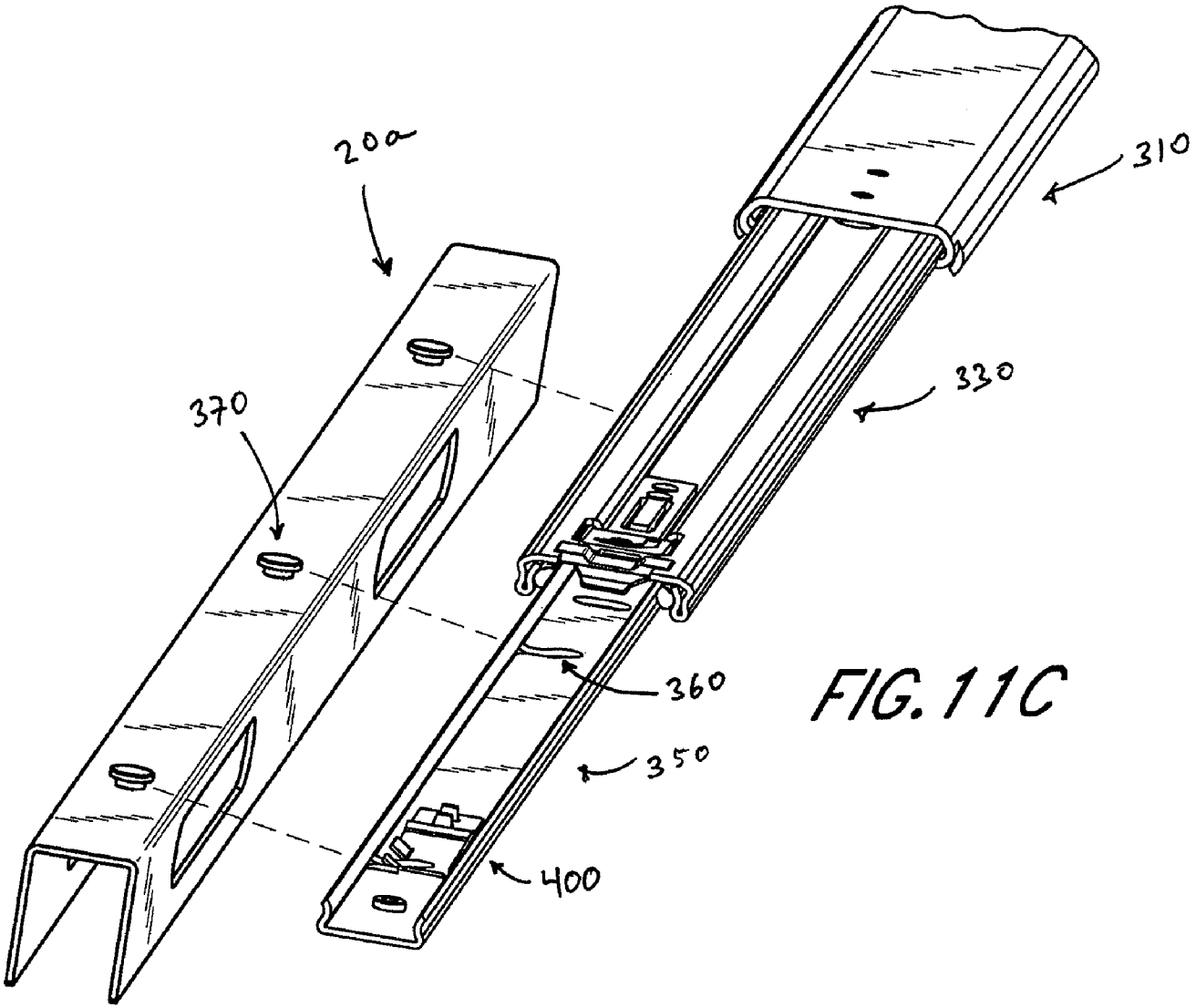
FIG. 11C is a schematic side view of another step of the method for attaching an object to the drop-in ball bearing assembly.
Figure 11D:
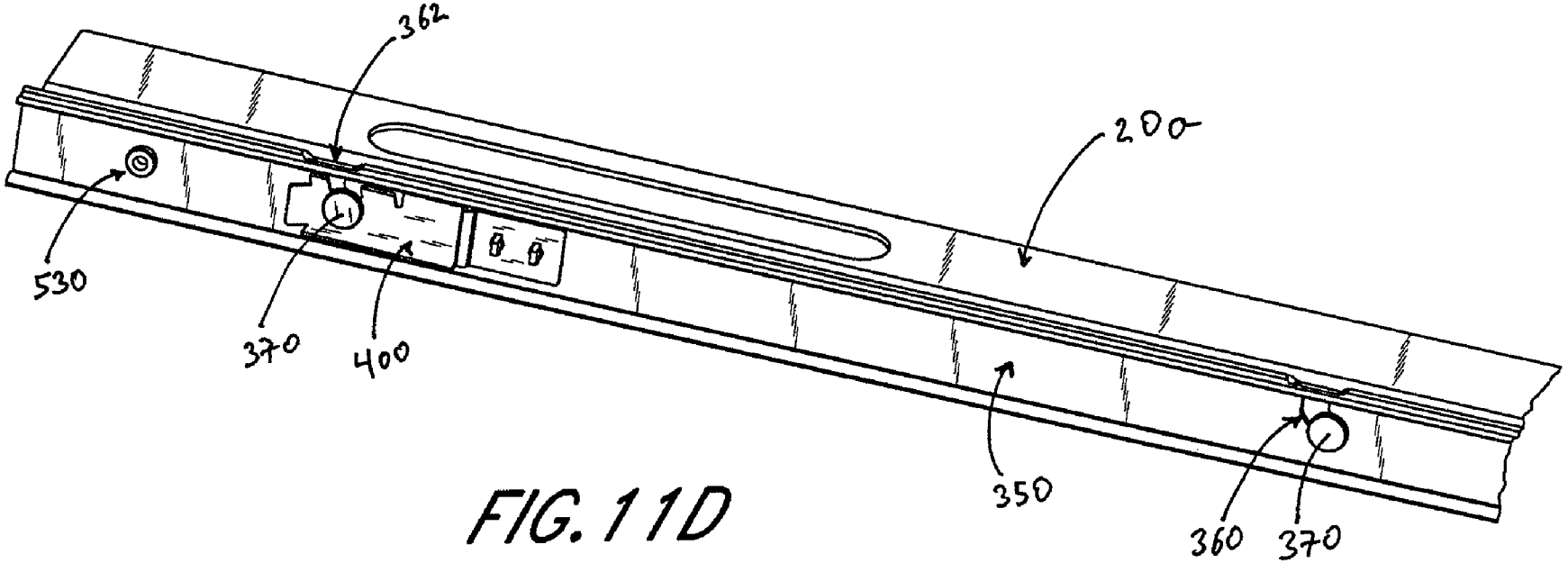
FIG. 11D is a schematic side view of another step of the method for attaching an object to the drop-in ball bearing assembly.

As shown in FIG. 10, in one embodiment a lock can be provided to inhibit the removal of the mounts 370 from the slots 360 on the movable slide segment 350. In the illustrated embodiment, the lock is a leaf spring 400 mounted on the side wall 356 of the movable slide 350. The leaf spring 400 is preferably manufactured of a resilient and strong material, such as stainless steel. However, other suitable materials can be used. The leaf spring 400 extends between a mount end 410 and a free end 420 biased toward the side wall 356. The mount end 410 is preferably fastened to the side wall 356 of the movable slide 350 with any suitable fastener 412, such as welds, rivets and screws. The leaf spring 400 also preferably has a resilient tab 430 that at least partially aligns with the opening 362 of the slot 360 on the movable slide 350 when the leaf spring 400 is mounted to the movable slide 350. Additionally, the leaf spring 400 preferably has an opening 440 that substantially aligns with the neck portion 364 of the slot 360 when the leaf spring 400 is mounted to the movable slide 350. The operation of the leaf spring 400 is further discussed below.

FIGS. 11A-D illustrate the installation of an object on the slide assembly 300. In the illustrated embodiment, a bracket arm 20A is shown, with server pins or mounts 370 mounted to the arm 20A. The mounts 370 are aligned with the slots 360 in the movable slide 350 while the movable slide 350 is in an extended position, and the mounts 370 are inserted into the slots 360. Though not shown, the bracket arm 20A can be fastened to the server 20 prior to inserting the mounts 370 into the slots 360. Alternatively, the server 20 can have the server pins or mounts 370 mounted thereto, so that the server 20 can be mounted to the slide assemblies 300 without the use of the bracket arms 20A.

As shown in FIGS. 11A-D, one leaf spring 400 is mounted to the movable slide 350 and aligned with one of the slots 360. However, more than one leaf-spring 400 can be provided. As the server pin or mount 370 is inserted into the opening 362 of the slot 360, the mount 370 comes into contact with the resilient tab 430 of the leaf spring 400, such that further insertion of the mount 370 into the slot 360 urges the leaf spring 400 away from the side wall 356 of the movable slide 350. As the mount 370 continues traveling through the neck portion 364 of the slot 360, the mount 370 moves into the opening 440 of the leaf spring 400, allowing the leaf spring 400 to snap back into its biased position toward the side wall 356, therefore locking the mount 370 in the neck 364 of the slot 360. Accordingly, the server 20 can be secured to the slide assembly 300 and inhibited from inadvertent disengagement with the slide assembly 300.

Figure 12:
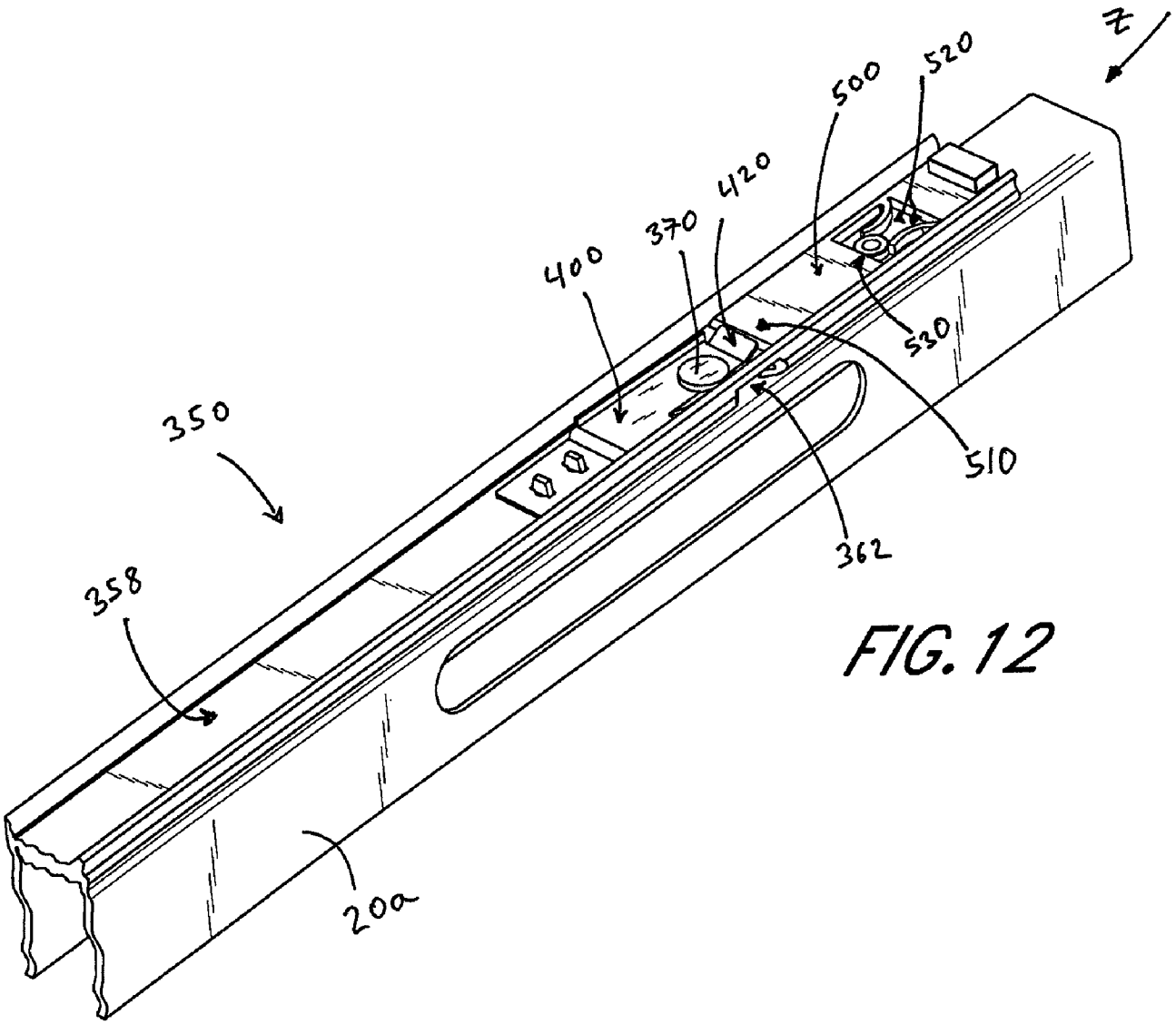
FIG. 12 is a schematic view of a resilient component for use with the locking member in FIG. 10.

FIG. 12 shows one embodiment of a resilient component 500 that can optionally be fastened to the movable slide 350 for use with the leaf spring 400. The resilient component 500 is preferably manufactured of a resilient plastic material, such as Delrin® by DuPont. However, other suitable resilient materials can be used. The resilient component 500 includes a forward end 510, which is preferably chamfered. The resilient component 500 can be pressed by a user toward the channel 358 of the movable member 350 in a direction Z, so that the forward end 510 engages the free end 420 of the leaf spring 400. For example, the forward end 510 can be wedged under a lip of the free end 420. The engagement of the forward end 510 and the free end 420 preferably lifts the leaf spring 400 away from the side wall 356. In the illustrated embodiment, the resilient member 500 includes two round-shaped legs 520, which preferably contact, and more preferably straddle, a nut 530, such as a PEM nut, attached to the movable slide 350. As the resilient member 500 is pressed toward the channel 358, the legs 520 move into greater contact with the PEM nut 530 (e.g., such that a surface of each leg 530 is generally tangent to the nut 530), which generates sufficient friction to hold the resilient component 500 in place as it is pushed forward. Accordingly, with the leaf spring 400 urged away from the side wall 356, the server 20 or other object can be easily removed from engagement with the slide assembly 300 by removing the server pins or mounts 370 from the slots 360 without having to manually hold the leaf spring 400 in an open position. As the server 20 is removed, the server pin or mount 370 moves along the slot 360 and pushes the resilient component 500 back into its original location, thereby resetting it. The leaf spring 400 is therefore no longer urged away from the side wall 356 and can once again lockingly engage the server pin or mount 370 when the server 20 is re-mounted to the slide assembly 300.

Although this invention has been disclosed in the context of a certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims.

What is claimed is:

1. A non-disconnect drop-in ball bearing slide assembly for supporting an object comprising:

a stationary slide;

an intermediate slide slidably connected to the stationary slide with at least one ball bearing interposed between the intermediate slide and the stationary slide;

a ball bearing retainer having a top member and a base member, the top and base members extending along a length, a first plurality of ball bearings extending along the length of base member, and a second plurality of ball bearings extending along at least a portion of the length of the top member; and a moveable slide extending along a length and having a top rail and a bottom rail, the moveable slide having at least one slot formed on the top rail for receiving a mounting post of an object, the moveable slide slidably supported within the intermediate slide by the ball bearing retainer, wherein the first plurality of ball bearings are interposed between the bottom rail and the base member and the second plurality of ball bearings are interposed between the top rail and the top member, wherein one or more of the at least one slots in the moveable slide align with a corresponding aperture in a bearing surface of the intermediate slide when the moveable slide is in a fully-extended position to thereby allow a mounting post to extend through said aperture into the corresponding slot, the ball bearing retainer configured so that the second plurality of ball bearings do not obstruct passage of said mounting post through said aperture into said corresponding slot.

2. The drop-in ball bearing slide assembly of claim 1, further comprising a lock actuatable to retain the mounting post in the slot.

3. The drop-in ball bearing slide assembly of claim 2, wherein the lock is a leaf spring.

4. The drop-in ball bearing slide assembly of claim 2, wherein the lock is selectively actuatable to allow the withdrawal of the mounting post from the slot.

5. The drop-in ball bearing slide assembly of claim 4, wherein the lock is moved into an original biased position as the mounting post is withdrawn from the slot.

6. The drop-in ball bearing assembly of claim 4, wherein a resilient component mounted to the moveable slide is actuatable to move the lock into a position that facilitates the withdrawal of the mounting post from the slot.

7. The drop-in ball bearing assembly of claim 1, wherein the second plurality of ball bearings extend along a length that is shorter than a length along which the first plurality of ball bearings extend such that the second plurality of ball bearings do not obstruct access to the at least one slot in the movable slide.

8. The drop-in ball bearing slide assembly of claim 1, wherein the moveable slide extends completely outside of the stationary slide when the slide assembly is fully extended.

9. The drop-in ball bearing slide assembly of claim 1, further comprising a lead-in guide disposed on the intermediate slide, the lead-in guide configured to substantially inhibit the movable slide from twisting out of engagement with the intermediate slide.

10. A drop-in ball bearing slide assembly for supporting an object comprising:

a stationary slide;

an intermediate slide slidably mounted to the stationary slide;

a ball bearing retainer having a first elongate member, a second elongate member and at least one connecting member between the elongate members, the first and second elongate members extending along a length, a first plurality of ball bearings extending along the length of first member, and a second plurality of ball bearings extending along at least a portion of the length of the second member;

a moveable slide extending along a length and having a top member and a bottom member, the moveable slide having at least one slot for receiving a mounting post of an object, the moveable slide slidably mounted to the intermediate slide by the ball bearing retainer, wherein the first plurality of ball bearings are interposed between the first member and the bottom member and the second plurality of ball bearings are interposed between the second member and the top member; and a lead-in guide disposed on the intermediate slide, the lead-in guide configured to substantially inhibit the movable slide from twisting out of engagement with the intermediate slide, wherein one or more of the at least one slots in the moveable slide align with a corresponding aperture in a bearing surface of the intermediate slide when the moveable slide is in a fully-extended position to thereby allow a mounting post to extend through said aperture into the corresponding slot, the ball bearing retainer configured so that the second plurality of ball bearings do not obstruct passage of said mounting post through said aperture into said corresponding slot.

11. The drop-in ball bearing slide assembly of claim 10, further comprising means for selectively locking and unlocking the mounting post in the slot of the moveable slide.

12. The drop-in ball bearing slide assembly of claim 10, wherein the moveable slide slides within the intermediate slide.

13. The drop-in ball bearing slide assembly of claim 10, wherein the moveable slide slides over the intermediate slide.

14. The drop-in ball bearing slide assembly of claim 10, wherein access to the at least one slot is unobstructed by the first and second plurality of ball bearings.

15. The drop-in ball bearing slide assembly of claim 10, wherein the at least one slot is formed on the top member.

16. The drop-in ball bearing slide assembly of claim 10, wherein a third plurality of ball bearings are interposed between the intermediate slide and the stationary slide.

17. The drop-in ball bearing slide assembly of claim 10, wherein the stationary slide, intermediate slide and moveable slide, form a compact assembly.

18. The drop-in ball bearing slide assembly of claim 17, wherein the width of the assembly is no more than about 1 inch.

19. A drop-in ball bearing slide assembly for supporting an object comprising:

a stationary slide;

an intermediate slide slidably supported within the stationary slide, the intermediate slide having a top rail, a bottom rail, and at least one aperture formed on the top rail of the intermediate slide;

a ball bearing retainer having a first elongate member, a second elongate member and at least one connecting member between the elongate members, the first and second elongate members extending along a length, a first plurality of ball bearings extending along the length of first member, and a second plurality of ball bearings extending along at least a portion of the length of the second member; and a moveable slide extending along a length and having a first member and a second member, the moveable slide having a first slot and a second slot formed on the first member, each slot configured to receive a corresponding mounting post of an object, the moveable slide slidably supported within the intermediate slide by the ball bearing retainer, wherein the first plurality of ball bearings are interposed between the first member and the top rail and the second plurality of ball bearings are interposed between the second member and the bottom rail, wherein the first slot is disposed within the intermediate slide when the moveable slide is in an extended position, the first slot aligned with one of the at least one apertures on the intermediate slide.

20. The drop-in ball bearing slide assembly of claim 19, wherein access to the first slot is unobstructed by the ball bearing support.

21. The drop-in ball bearing slide assembly of claim 19, further comprising a third slot formed on the first member, the third slot disposed within the intermediate slide when the moveable slide is in the extended position, the third slot aligned with another of the at least one apertures.

22. The drop-in ball bearing slide assembly of claim 21, wherein the first, second and third slots are equidistant from each other.

* * * * *